United States Patent [19]

Masenheimer et al.

[11] 4,281,370

[45] Jul. 28, 1981

[54] SWIVEL BASE LIGHTING FIXTURE

[75] Inventors: John H. Masenheimer, Prospect, Ky.; Irving Bradley, Novelty, Ohio

[73] Assignee: General Electric Company, Schenectady, N.Y.

[21] Appl. No.: 64,403

[22] Filed: Aug. 7, 1979

[51] Int. Cl.[3] ..... F21V 29/00

[52] U.S. Cl. ..... 362/287; 362/147; 362/419; 362/426

[58] Field of Search ..... 362/287, 147, 419, 426

[56] References Cited

U.S. PATENT DOCUMENTS 4,160,285 7/1979 Shibla ..... 362/287 X

*Primary Examiner*—Stephen J. Lechert, Jr.

*Attorney, Agent, or Firm*—Lawrence R. Kempton; Philip L. Schlamp

[57] ABSTRACT

A portable swivel base lighting fixture comprising a housing, a two-component base and a connecting arm which supportively attaches housing to the base. The base includes an outer or cover member which recessively surrounds an inner member. The outer and inner members are rotationally operable relative to each other to permit rotational positioning of the lamp.

8 Claims, 4 Drawing Figures

SWIVEL BASE LIGHTING FIXTURE

This invention relates to portable lighting fixtures which can be mounted exteriorly and more particularly to a simple lightweight swivel-based lighting fixture having a two-component swivel base comprising an outer cover member surrounding an inner or recessed member. The two-base members engage each other for securely positioning the fixture and can be easily disengaged to readily permit free rotational repositioning of the fixture.

BACKGROUND

Prior art positionally adjustable lighting fixtures combine the support and positional adjustment features in a single joint. Adjustable fixtures such as floodlamp receptacles, extension arm lamps or track lights carry the fixture weight at the point of adjustment and require rigid adjustable joints. These fixtures have rotationally operable members which are continuously frictionally engaged. A user must apply a force sufficient to overcome the ordinary frictional engagement forces to adjust the fixture. The fixtures are often complex and relatively heavy. Adjustment is troublesome inasmuch as the fixture weight must be counterbalanced while the adjustable joint is tightened. The fixture weight continuously bears on the adjustable joint and often necessitates readjustment of that joint. Tighter more secure joints are more troublesome to adjust.

SUMMARY OF THE INVENTION

Lighting fixtures in accordance with the present invention are lightweight and easily adjustable and have a swivel base comprising at least two members which engage each other for securely positioning the fixture. The base members can be readily disengaged to permit free rotation of the base members relative to each other for rotationally orienting the fixture.

Lighting fixtures of the present invention can include a housing at least partially enclosing a lamp and a socket, a two-component swivel base and a connecting member which supportively attaches the housing to the swivel action base.

A swivel action base in accordance with the present invention includes at least two components: an outer or cover member and an inner or plate member. The outer base at least partially surrounds and recesses the inner member. A retention means, such as a plurality of interiorly projecting tabs, articulated from the lower edge of the outer cover base lockingly recess the inner base yet permit free rotation of the inner base within the cover. The fixture weight in combination with the base retention means causes the base cover to engage the inner base and securely positions the cover and the fixture relative to the inner base. The interior of the cover rotationally cooperates with the inner base. The interior edge of the cover member which engages the inner base can be approximately circular and the perimeter of the inner member can, cooperatively be approximately circular.

The fixture is easily rotationally reoriented by for instance lifting the cover member to relieve the fixture weight bearing on the inner member and thereby disengaging the cover and the inner base to permit free rotation of the cover relative to the inner base.

Additionally, the fixture center of gravity can be approximately coaxial with the connecting arm and the axis of the lamp to minimize the tendency of the fixture to spontaneously impart rotational movement to the base.

The fixture can be attached to an exterior surface such as a vertical wall by an attachment receptacle, such as keyhole slot provided in the inner base member, which receives a hook or nail embedded in the exterior wall. The fixtures of the present invention can be suspended from a wall and need not be rigidly attached thereto by for instance adhesive or a plurality of fasteners.

The inner base can be positionally fixed relative to a wall while the fixture and cover member which engage the inner member remain rotationally movable with respect to the inner member and the wall.

Fixtures of the present invention can be molded substantially from low cost heat resistant plastics for lightweight and durable construction which facilitate easy rotational movement and can resiliently receive external impacts and, accordingly, minimize safety hazards.

The inner base members can be a circular metal plate which is not easily displaced by the rotation of the fixture. A metal inner base member additionally lowers the fixture center of gravity and inhibits tilting of the fixture.

The housing of the present invention can further be provided with an adjustable support arm to enhance the directional positioning of the lamp.

The rear of the fixture housing may be vented to establish chimney effect cooling.

In a preferred application, the fixture of the present invention provides a portable decorative down-light useful in illuminating and accenting various articles such as plants or other household items.

Other objects and features and a more complete understanding of the present invention which may admit of a number of possible variations, will be seen from the following detailed description which taken in conjunction with the drawings represents the preferred embodiments of this invention.

DETAILED DESCRIPTION

Figures 1, 2:
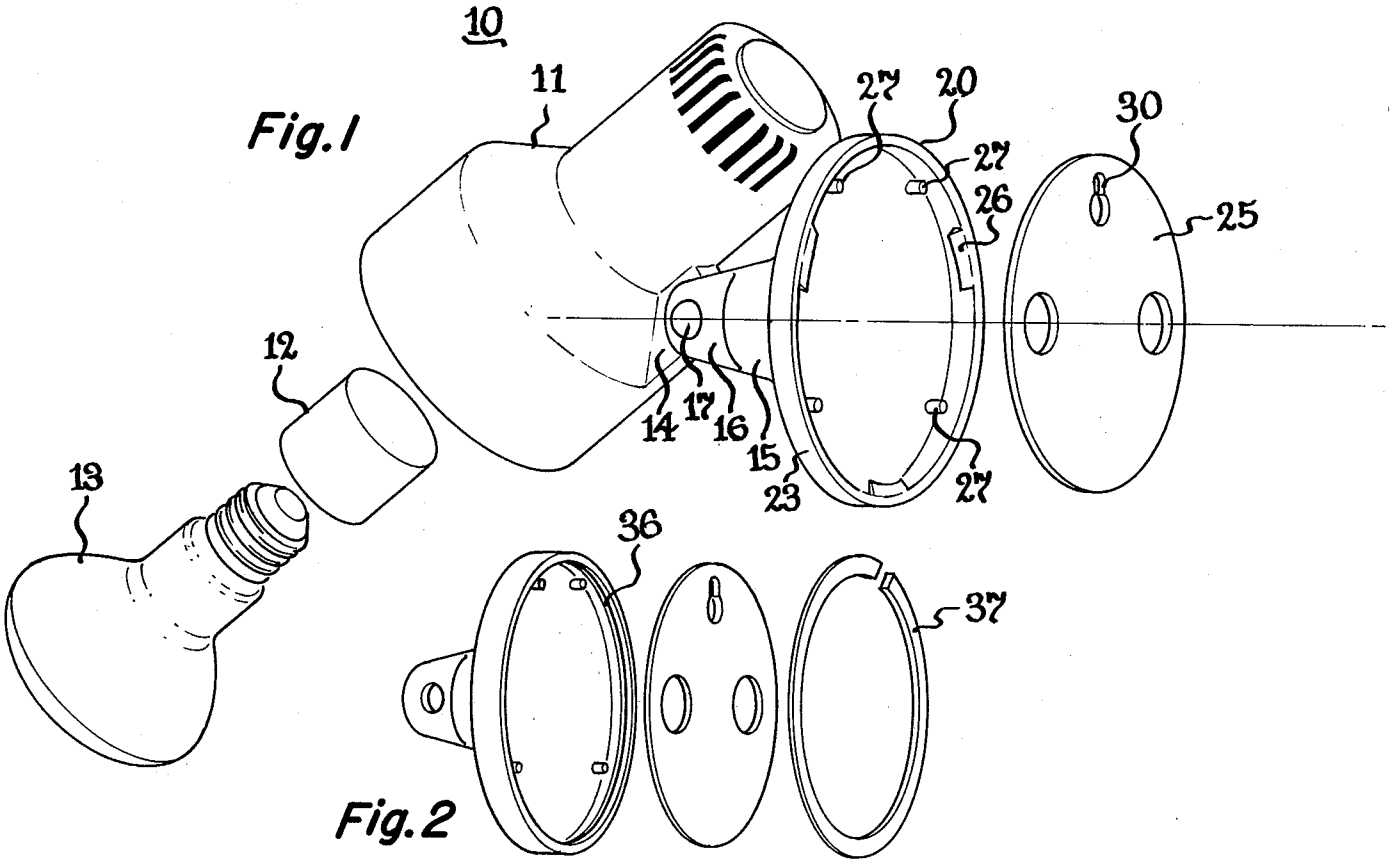
FIG. 1 is an exploded perspective view of the fixture in accordance with the present invention.
FIG. 2 is a perspective view of the outer base having an alternate retaining means.

Referring now to FIG. 1, an exploded perspective view of a lamp fixture in accordance with the present invention is shown. The dashed line therein indicates the axis of the fixture. A housing 11 is adapted to receive and at least partially enclose a socket 12 and a lamp 13. The housing 11 as well as other fixture components can be molded from low-cost heat resistant thermoplastic having a heat distortion temperature in excess of approximately 100° C. such as Hercules 6523 or Arco 8622 polypropylene homopolymers. In a preferred embodiment, the housing 11 can be molded with a recess for receiving a lamp socket therein. The lamp socket can be frictionally engaged, spring loaded, snap fitted, or otherwise registered within the interior of the housing 11.

The socket 12 can be a standard socket adapted to cooperate with a conventional lamp 13 and more particularly can be a heat resistant ceramic socket.

Lamp 13 can be any conventional bulb and more particularly can be a reflector or PAR lamp having a wattage in the range of approximately 75 to 150 watts. In a preferred embodiment, lamp 13 may be a General Electric Gro & Sho 75 watt R-30 bulb which is particularly adapted to accentuate and emphasize a plant's environment.

Housing 11 can directly engage a support arm 15 and be molded integrally therewith or alternatively can be adapted to cooperatively engage a suport arm 15. The housing 11 may include a lower portion 14 specially adapted to engage the support arm 15. In a preferred embodiment the lower housing portion 14 can be molded as a rectangular block mount. The support arm 15 can be located along the axis of the fixture and can be adapted to cooperate with the housing lower portion 14 and more particularly can be slotted to receive the housing mount 14 between its bifurcated end portions 16. A transverse opening through the support arm 15 and a lower housing portion 14 can be provided for receiving a fastening means 17 such as a screw and nut or other fastener.

If the depth of the support slot is greater than the height of the lower housing portion 14, pivotal movement of the housing 11 with respect to the support 15 can be achieved for directionally positioning the fixture.

The opposite end of the support member 15 can be adapted for instance by threading to engage an outer base member 20 or can, in a preferred embodiment, be molded integrally therewith. The support arm 15 can be rigidly and permanently affixed to an outer base member 20 to transmit forces exerted by the fixture 10 directly to the base 20.

The outer or cover member 20 is configurated to distribute the forces exerted thereon to an external supporting structure. In a preferred embodiment the outer base portion 20 can have a circular cross-section with a diameter sufficient to inhibit tipping or tilting of the lamp fixture 10.

The outer base member 20 can be hollow and can have a depth sufficient to receive an inner base member 25 therein. The exterior of the cover 20 can have an esthetically pleasing configuration and can for instance be dome shaped. A lower edge 23 of the cover 20, in a preferred embodiment, can be an approximately upright cylindrical wall. The interior of the cover 20 is adapted to cooperate rotationally with an inner member 25.

Inner base member 25 is shaped to rotationally cooperate within the interior recess of the cover 20 and can be snap fitted therein. Inner base member, in a preferred embodiment, can be a circular plate having a diameter slightly less than the inside diameter of the outer base 20 and a thickness sufficient to impart rigidity and weight. More particularly, inner base member may be a circular metal plate.

Inner base member 25 can be retained within the outer base member 20 by retaining means articulated interiorly from the lower edge of the cover 20. In a preferred embodiment the retaining means may be tabs 26 or as shown in FIG. 2, a groove 36 about the interior periphery of cover 20 having an expandable C-clip 37 therein. In a preferred embodiment the inner base 25 is recessed within the outer base 20 and consequently not in direct planar contact with an exterior surface. The inner base member can, however, be adapted to be externally attached to an exterior surface by for instance a slot 30 which may be secured to a screw or hook embedded for instance in an exterior vertical wall.

The inner base member 25 can be held within the cover 20 by a retention means 26. Additionally the cover 20 can be provided with interior stops 27 which engage perpendicularly the interior face of the inner base. Stops 27 cooperate with the retention means 26 to limit the axial movement of the inner plate 25. In a preferred embodiment, a clearance should be provided between retention means 26 and stops 27, which clearance should be slightly more than the thickness of the inner base 25. Such clearance permits free rotation of the inner base plate 25 between the retention means 26 and the stops 27.

Figure 4:
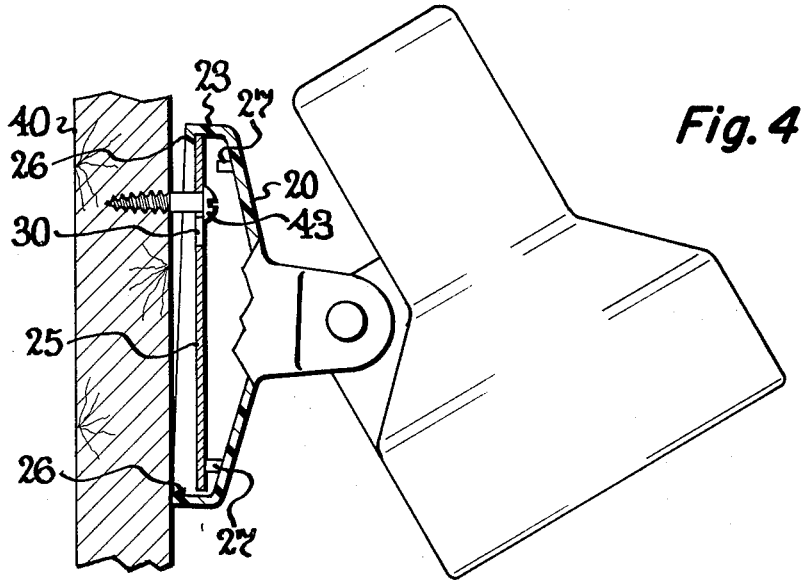
FIG. 4 is a cross-sectional view of a fixture in accordance with the present invention applied to a vertical wall in a secure position.

In operation the fixture of the present invention can be applied to a vertical wall 40 cross-sectionally shown in FIG. 4. The inner base plate 25 can be secured to a hook or nail 40 through a keyhole receptacle 30. The upright approximately cylindrical lower wall 23 of the cover 20 abuts the vertical wall 40. The inner plate 25 is displaced from a perpendicular with the axis of the fixture by the weight of the fixture, and is frictionally engaged between tab 26A on its outer surface and stop 27B on its inner surface. The engagement is sufficiently tenacious to securely position the fixture relative to the inner plate and hence the wall. Additionally, the fixture components have been designed to establish a center of gravity which is coaxial with the fixture of the lamp to thereby minimize the tendency of the fixture itself to spontaneously impart rotational movement of the fixture. Further, the fixture components such as the housing, support arm and cover base may be fabricated of low-cost lightweight plastic in order to lower the fixture center of gravity for the reduction of fixture moment which may be exerted upon the inner base member. Accordingly, it is readily seen in this embodiment that the inner base plate lockingly secures the fixture in a selected rotational position, which position may be maintained indefinitely without the need of additional fasteners.

Figure 3:
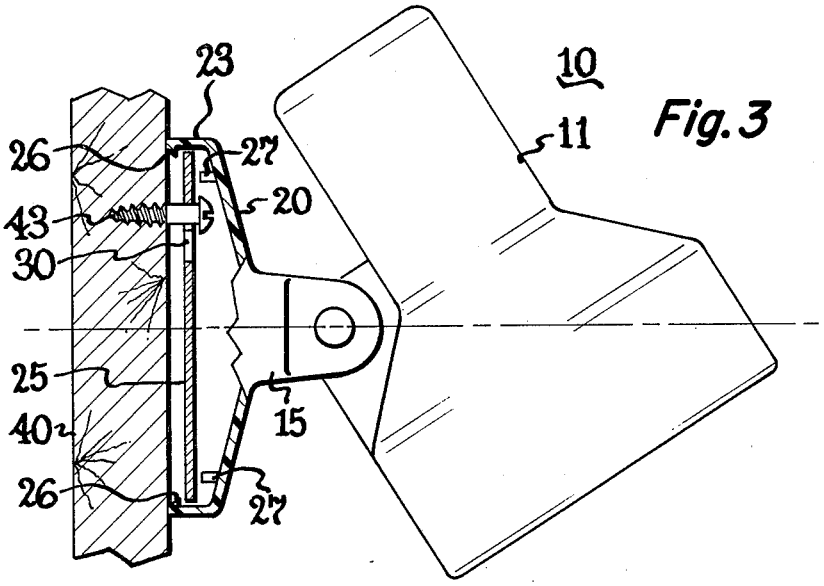
FIG. 3 is a cross-sectional view of a fixture in accordance with the present invention as applied to a vertical wall in a released position, to permit repositioning of the fixture.

However, as alternately shown in FIG. 3, the fixture in accordance with the present invention may be easily rotated to reposition the lamp. In the repositional mode of operation, fixture 10 is lifted to release the inner plate member 25 from its engagement between stops 27 and tab 26. Accordingly the cover 20 is freely rotatable with respect to the inner base 25. More particularly fixture 10 can be rotated without contacting inner plate 25. The force required to rotate the fixture 10 is attributable to the weight of the fixture alone. Additional force necessary to overcome various frictional engagements employed in the prior art is not required.

It will be apparent from the foregoing description to those skilled in the art that various modification can be made in the above described preferred embodiments which are still within the scope and spirit of the present invention. For example, as previously noted, a variety of materials can be used for the fixture housing, connecting arm and cover provided they are sufficiently rigid and capable of being permanently shaped. Similarly, the base retention means may take a variety of forms, two of which have been previously noted. While the preferred embodiments have described the cover and inner bases as being circular, a variety of other base configurations are recognizable within the present invention. Particularly, the bases need not provide for 360° rotation. It is therefore intended to limit the scope of the present invention only by the scope of the following claims.

What we claim as new and desire to secure by Letters Patent of the United States is:

1. A swivel-base lighting fixture comprising:

a lamp, a socket, a housing for at least partially enclosing the said lamp and socket, an inner base, an outer base, a connecting arm for supportively attaching said housing to said outer base, said outer base at least partially surrounding and recessing said inner base and having a means for retaining said inner base therein, the interior of said outer base and the exterior of said inner base being cooperatively configured to permit rotational movement therebetween, wherein said inner base engages said outer base to secure the angular position of said fixture.

2. A swivel-base portable lighting fixture in accordance with claim 1 wherein the interior of said outer base has a circular cross-section.

3. A swivel-base portable lighting fixture of claim 2 wherein said outer base circular cross-section is taken in a plane perpendicular to the axis of the fixture.

4. A swivel-base portable lighting fixture in accordance with claim 2 wherein the interior diameter of said outer base member is slightly larger than the exterior diameter of said inner base member.

5. A portable swivel-base lighting fixture in accordance with the claim 1 wherein said connecting arm includes a pivotal joint therein for the directional positioning of said lamp.

6. A portable swivel-base lighting fixture in accordance with claim 1 wherein said retaining means is a plurality of tabs interiorly articulated from a lower edge of said outer base.

7. A portable swivel-base lighting fixture in accordance with claim 1 wherein said inner base is a circular metal disk.

8. A portable swivel-base lighting fixture in accordance with claim 1 wherein said retaining means includes a groove in the interior of said cover member and a C-clip retaining means which expansively cooperates therewith.

* * * * *